United States Patent [19]

Lee, Jr.

[11] 4,000,603

[45] Jan. 4, 1977

[54] TEXTILE YARN SPINNING MACHINE WITH SUPPLY STRAND INTERRUPTION

[75] Inventor: Charles D. Lee, Jr., Charlotte, N.C.

[73] Assignee: Parks Cramer Company, Fitchburg, Mass.

[22] Filed: Feb. 27, 1975

[21] Appl. No.: 553,795

[52] U.S. Cl. ..... 57/87; 57/34 R

[51] Int. Cl.[2] ..... D01H 13/18

[58] Field of Search ..... 57/34 R, 78, 86, 87, 57/80, 81

[56] References Cited

UNITED STATES PATENTS

| | | | |
|---|---|---|---|
| 919,354 | 4/1909 | Houghton | 57/87 |
| 1,103,329 | 7/1914 | Vales | 57/87 |
| 3,726,072 | 4/1973 | Ford et al. | 57/34 R |

*Primary Examiner*—John Petrakes

*Attorney, Agent, or Firm*—Bell, Seltzer, Park & Gibson

[57] ABSTRACT

Positive interruption of supply strand feeding to drafting systems of a textile yarn spinning machine is assured by the cooperation of rings for threadingly receiving corresponding supply strands and plugs for positively entrapping a threadingly received supply strand upon movement of a plug into a position penetrating a corresponding ring.

5 Claims, 7 Drawing Figures

TEXTILE YARN SPINNING MACHINE WITH SUPPLY STRAND INTERRUPTION

It has heretofore been the practice, in the production of textile yarn from textile fibers through the use of a textile yarn spinning machine, to accommodate interruption of yarn formation upon breakage of an attenuated strand issuing from a drafting system by taking up the attenuated strand in a "vacuum end collection" apparatus. Reinstitution of yarn production (known as "piecing-up") has involved the joining of a strand of yarn to the attenuated strand issuing from the drafting system, either by a manual operation performed by an operator or by a mechanical operation performed by an appropriate apparatus. Any reader interested in disclosures of suitable apparatus is referred to a number of prior patents including, by way of example only, U.S. Pat. No. Re. 26,230 to Escursel-Pratt; U.S. Pat. No. 3,373,551 to Gillono et al; U.S. Pat. No. 3,403,866 to Bell et al; and U.S. Pat. No. 3,486,319 to Lee et al.

It has been proposed more recently that the supply strands normally delivered to drafting systems of a textile yarn forming machine, to be drawn in the production of attenuated strands, be interrupted in the absence of continuing production of yarn. Certain difficulties and deficiencies possibly encountered in continuing production of yarn after breakage of an attenuated strand are thereby avoided. Any interested reader may obtain a more complete understanding of the desirable results thus achieved and one successful operating embodiment of such an apparatus from U.S. Pat. No. 3,726,072 to Ford et al. Other supply strand interruption apparatus may be found in the disclosures of U.S. Pat. No. 3,403,866 to Bell et al; U.S. Pat. No. 3,498,039 to Kent et al and U.S. Pat. No. 3,568,425 to Zegna et al.

Growing usage and anticipation of usage of the arrangements disclosed by the aforementioned prior patents have now revealed certain difficulties and shortcomings which desirably are to be avoided. In particular, past practices concerning the gauge or spacing of spindles on a ring spinning frame and the supply of strands to a drafting system of such a frame have been undergoing reconsideration. Where practice has contemplated the use of relatively wide gauge frames to produce relatively large size packages of attenuated strands or yarns, the anticipated use of automatic yarn piecing equipment has lead to the resurgence of interest in narrow gauge frames. Such narrow gauge frames require rearrangement of the creels from which supply strands are drawn, particularly where large supply strands packages are to be used. With such creel rearrangement, the paths followed by supply strands may become such that any trailing end of a supply strand loosed from a package in the creel would drop into attenuated strands being produced, "breaking down" a number of adjacent yarns and hampering desired production. Other and related difficulties may be encountered in assuring that supply strands follow paths appropriate for desired cooperation with roving feed stop devices, in assuring that multiple supply strands delivered to a common drafting system are readily captured and interrupted, and in assuring that roving feed stop devices operate consistently without requiring frequent cleaning by an operator.

Having in mind the aforementioned circumstances and difficulties it is an object of the present invention to facilitate more positive interruption of supply strand feeding to the drafting systems of a textile yarn spinning machine. In realizing this object of the present invention, supply strands are threadingly received through corresponding rings, thereby positively locating the positions of the supply strands. When interruption of a supply strand is required or appropriate, a plug which cooperates with the corresponding ring is moved to a position penetrating and occluding the corresponding ring. The plug and ring then cooperate for positively entrapping the threadingly received supply strand.

One of the objects of the invention having been stated, other objects will appear as the description proceeds, when taken in connection with the accompanying drawings, in which FIG. 1 is a perspective view of a portion of a textile yarn spinning machine embodying this invention;

This invention will be described hereinafter with particular reference to the accompanying drawings, and the best mode contemplated for this invention will be set forth. However, it is to be understood at the outset that it is further contemplated that this invention may be modified by skilled artisans working in the relevant arts without departing from the benefits to be obtained from this invention. Accordingly, the description and illustration are to be understood broadly and are not to be understood as limiting upon possible modification of the invention.

Figures 1, 2:
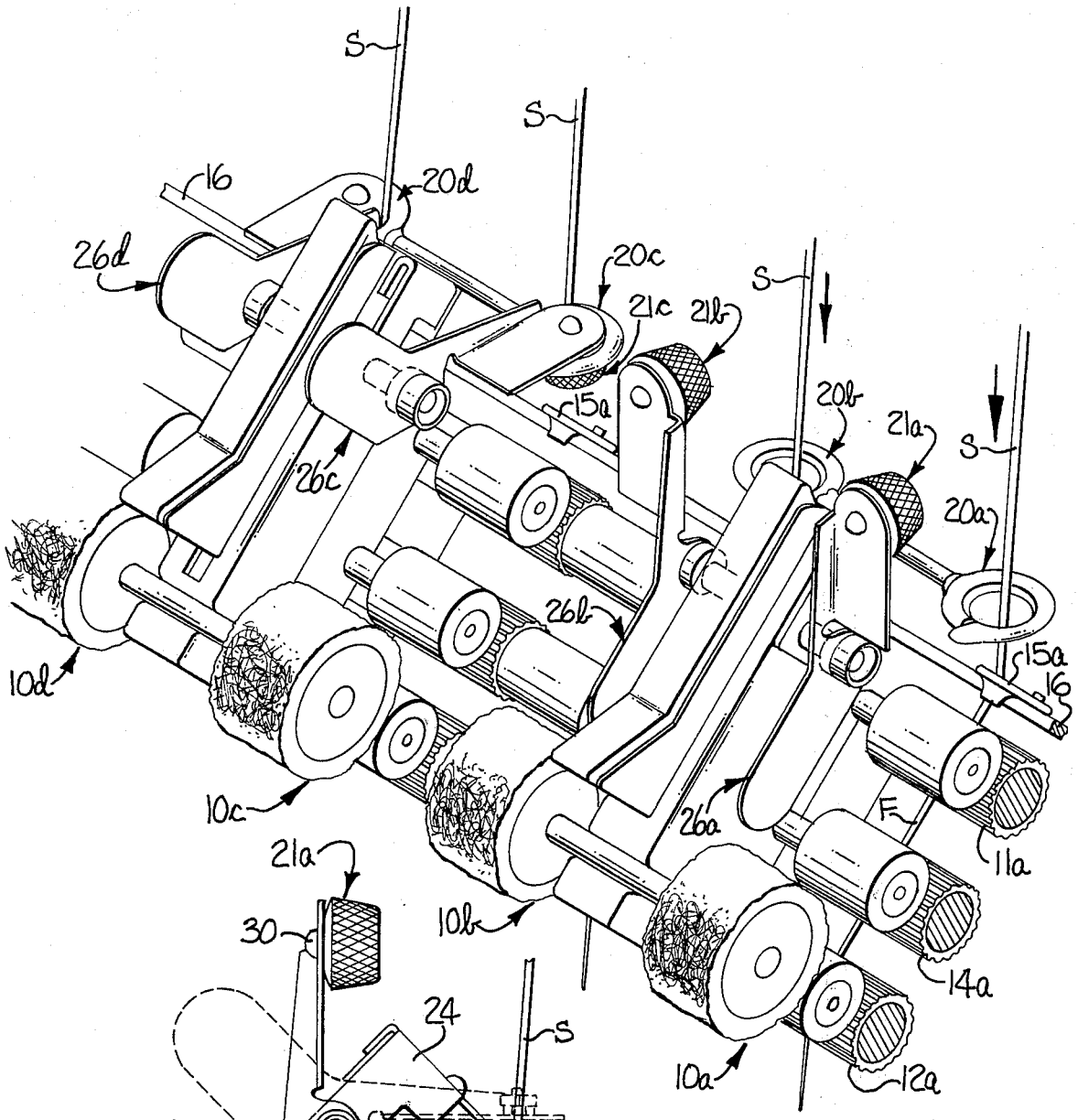
FIG. 2 is an end elevation view, partially in section and partially in phantom, through the textile yarn spinning machine portion of FIG. 1.

Referring now more particularly to FIGS. 1 and 2, a portion of a textile yarn spinning machine is there illustrated which includes a plurality of drafting systems respectively generally indicated at 10*a*, 10*b*, 10*c* and 10*d*. Each of the drafting systems comprises three cooperating sets of rolls including a set of rear rolls as generally indicated at 11*a* (FIG. 2); front or delivery rolls generally indicated at 12*a*; and intermediate rolls 14*a*. As is generally known to persons familiar with textile yarn spinning machines of the type illustrated, the series of rolls 11*a*, 12*a*, 14*a* define a series of aligned nips through which a textile fiber generally indicated at S passes for attenuation. Adjacent the rear rolls 11*a* is disposed a trumpet 15*a* which is mounted on a traverse bar 16. The trumpet 15*a* receives a supply strand S from a suitable supply package (not shown) and directs the supply strand into a corresponding drafting system 10*a*. As is known to persons familiar to textile yarn forming machines, the traverse bar 16 moves slowly in the direction of its longitudinal axis, causing the group of fibers F to traverse the longitudinal axis of the sets of rolls 11*a*, 12*a*, 14*a* to distribute wear and aid in achieving uniformity of the yarn produced.

In the illustrated embodiment, only a single supply strand S is delivered to each drafting systems 10*a*, 10*b*, 10*c*, 10*d*. Further, the supply strands S pass substantially directly vertically downwardly to the corresponding trumpets 15*a*, etc. It is to be understood that the supply strands S may be directed along other paths to the corresponding trumpet means and that the trumpet means may in some instances direct more than one supply strand to the corresponding drafting system.

Figure 7:
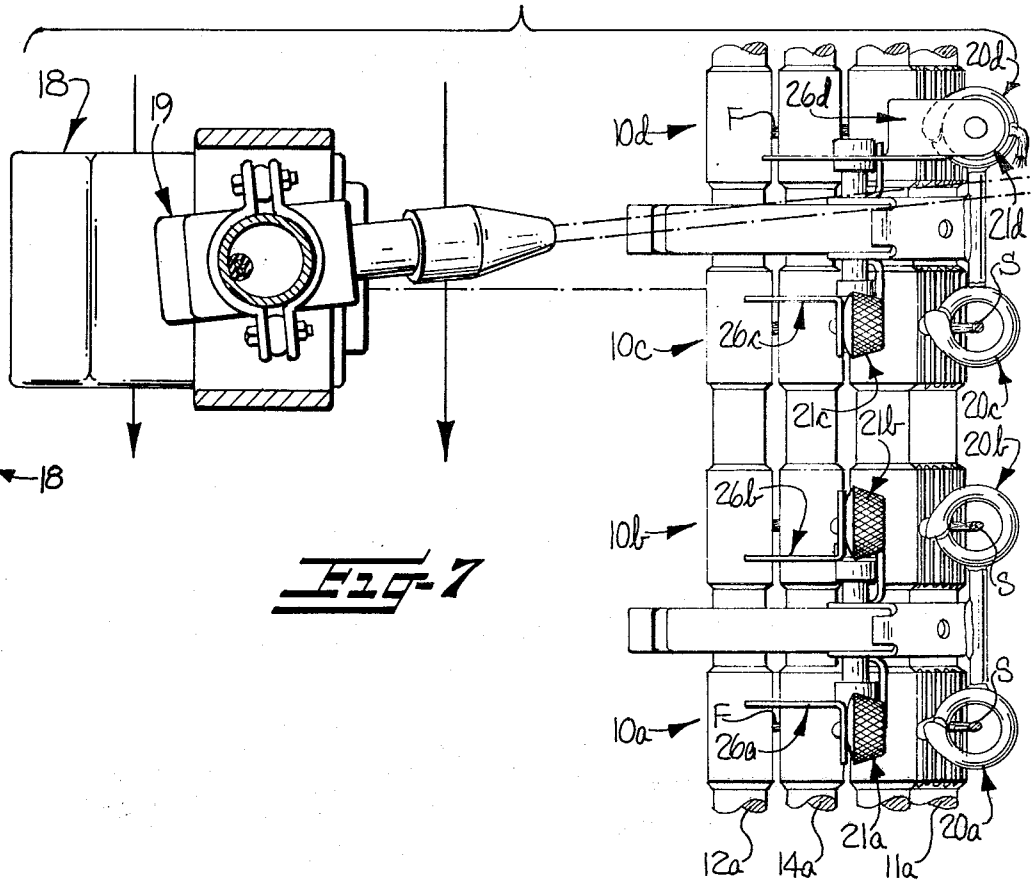
FIG. 7 is an enlarged plan view of a portion of the apparatus of FIG. 6, taken generally along the line 7—7 in FIG. 6.
Figure 6:
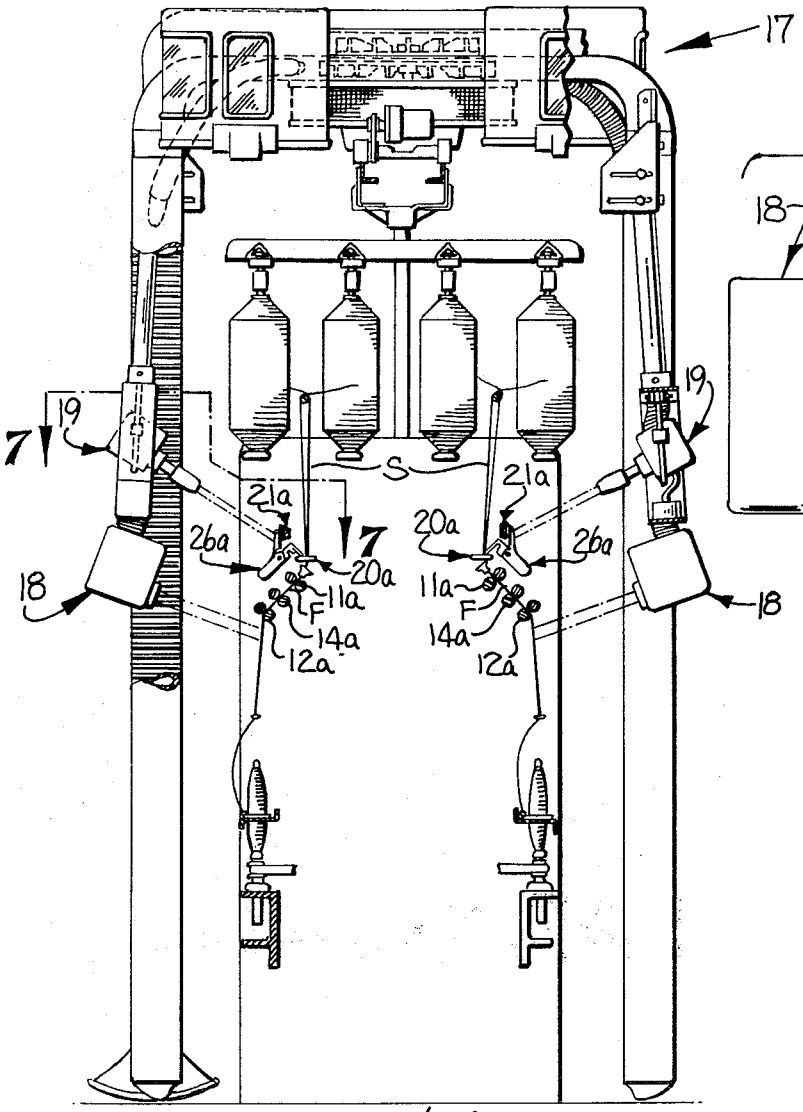
FIG. 6 is an end elevation view, partially in section and partially broken away, of the combination of the present invention.

Cooperating with the plurality of drafting systems 10*a*, 10*b*, 10*c* and 10*d*, arranged in a series, is means for monitoring delivery of attenuated strands and for responding to breakage of attenuated strands by interrupting the feeding of the corresponding supply strands S at a point in advance of introduction thereof into the corresponding trumpet means. It is contemplated that this means preferably include a traveling detector and actuator device generally indicated at 17 (FIGS. 6 & 7) in the form of a tender unit or servicing unit which is moved along the textile yarn forming machine including the series of drafting systems. That detection means 18 moving with the tender unit or servicing unit monitors the production of attenuated strands. At a drafting system where the attenuated strand has been interrupted (where there is an "end down"), a remote actuating device such as an air control valve 19 is operated to direct a flow of pressurized air or the like (FIG. 7) against a device as will be hereinafter described, to interrupt feeding of the corresponding supply strand.

In accordance with this invention, the textile yarn spinning machine is provided with a plurality of ring means such as the toruses generally indicated at 20*a*, 20*b*, 20*c* and 20*d*. Each of the ring means is interposed between a corresponding supply package (not shown) and a corresponding drafting system for threadingly receiving a corresponding supply strand S.

A plurality of plug means are provided for cooperating with the ring means with each plug means, for example the plugs generally indicated at 21*a*, 21*b*, and 21*c*, being mounted for movement relative to a corresponding ring between a strand feeding position withdrawn from the corresponding ring (such as the position of the plug 21*a*) and a strand interruption position penetrating the corresponding ring (such as the position of the plug 21*c*). As will be understood, a cooperating plug 21*a* and torus 20*a* positively trap the supply strand S which is threadingly received by the torus 20*a* upon movement of plug 21*a* to the strand interruption position. Due to the torus 20*a* positively locating and retaining the supply strand S, such entrapment is assured.

Figure 3:
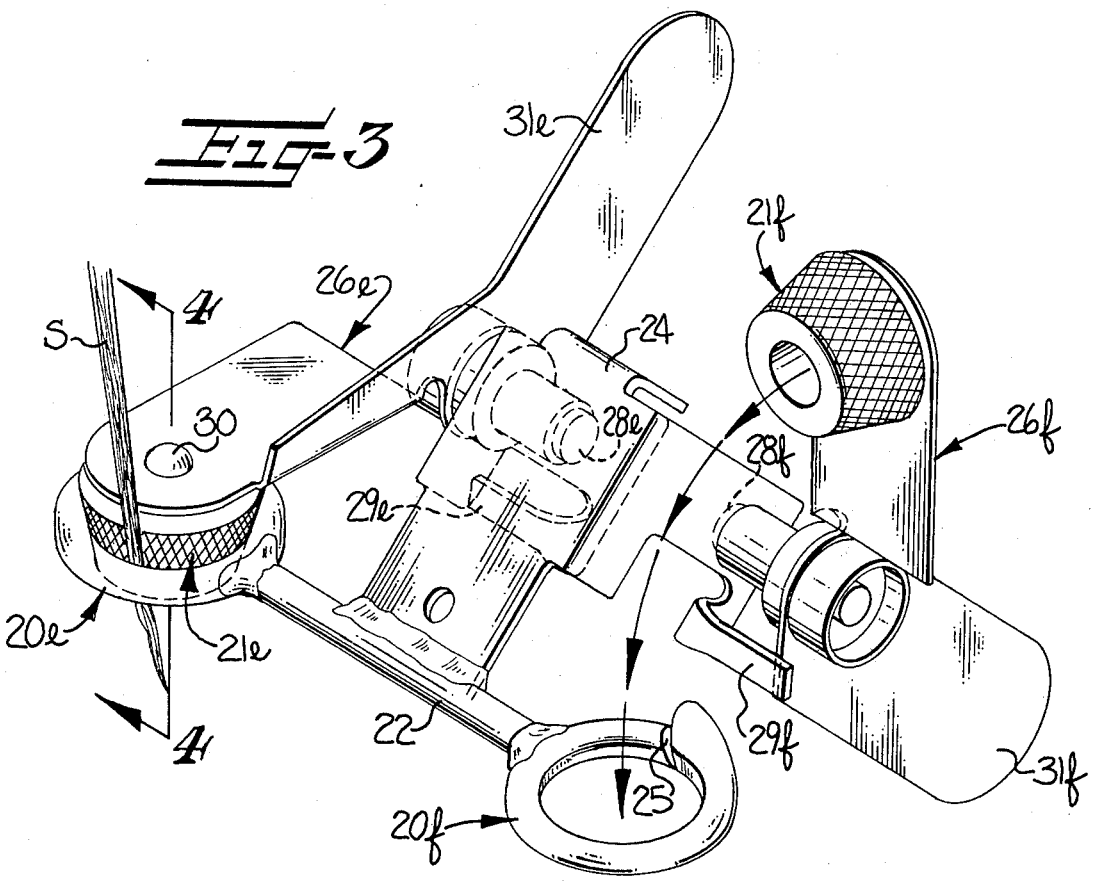
FIG. 3 is an enlarged perspective view of a supply strand interruption device in accordance with this invention, illustrating the manner of entrapment of a supply strand.
Figure 5:
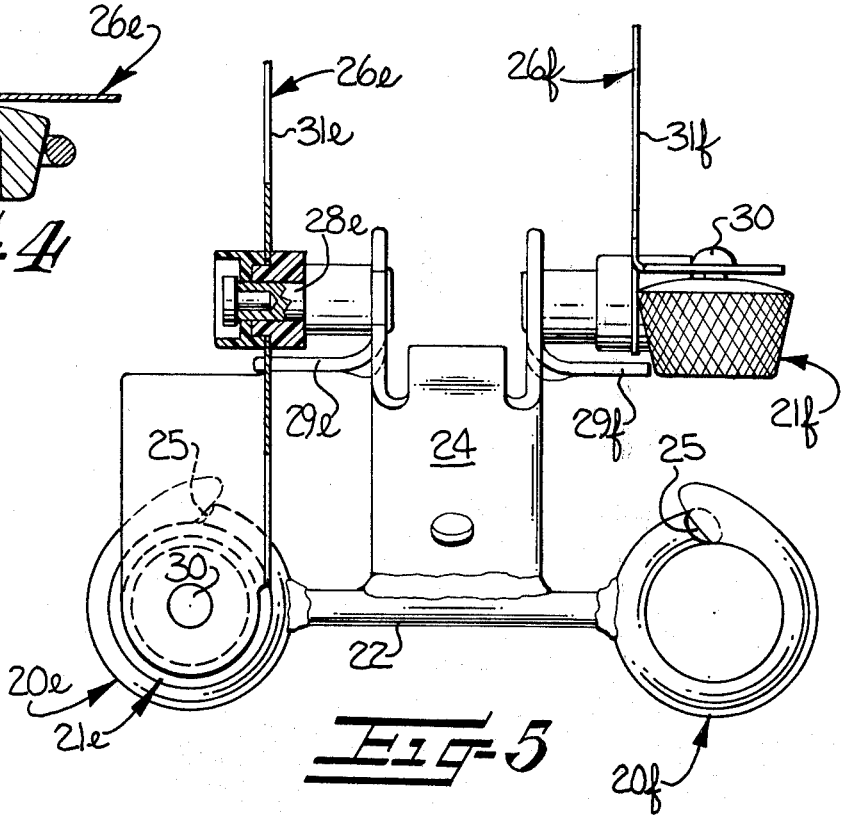
FIG. 5 is a plan view of the device of FIGS. 3 and 4.

It will be noted that the improved apparatus of this invention provides for mounting a pair of toruses in common to service adjacent drafting systems. In this manner, advantage is taken of the characteristic construction of many presentday textile yarn forming machines, in which weighting arrangements for the upper rolls are similarly shared between adjacent drafting systems. Referring now more particularly to FIG. 3, a pair of toruses generally indicated at 20*e*, 20*f* are there shown as being joined by a horizontal bar 22 which is in turn secured to a mounting bracket 24. Desirably, this mounting arrangement is such as to dispose the toruses 20*e*, 20*f* horizontally in spaced relation above the corresponding trumpets. Further, it is desired that the diameter of the toruses be sufficiently great to accommodate traversing movement of the trumpets through which the supply strands are delivered and are arranged so that the supply strand normally engages the inboard side of the corresponding torus. Persons familiar with textile yarn forming machines will be aware that drafting systems conventionally are mounted for directing strands downwardly and outwardly therethrough, with the drafting systems being mounted at a 45 or 60 degree angle. The reference here to an inboard or inward location refers to the angulation of mounting of such a drafting system. It is to be noted that each torus may define a threading split (such as the split 25 visible in FIG. 3) at an outward portion thereof for facilitating threading of supply strands thereinto. The positioning of the threading split 25 at an outward portion of the torus is such as to avoid interference with normal advancement of supply strands which engage the diametrically opposite portion of the torus. If present, the threading split may have an adjacent extended lip (FIGS. 3 and 5) to aid in initial threading of the supply strand. However, the split may be omitted if desired and the tori formed as complete circles.

Each of the plugs 21*e*, 21*f* (FIGS. 3 through 5) cooperating with the ring means is carried by a corresponding pivoting member as generally indicated at 26*e*, 26*f*, supported from the bracket 24 for pivotal movement about an axis spaced above and outwardly of the corresponding drafting system. The pivoting members 26*e*, 26*f* are mounted for movement on a pivotal axis defined by pivot pins 28*e*, 28*f* extending from portions of the bracket 24 and, when moved to a position at which the corresponding plugs 21*e*, 21*f* are retracted from the cooperating rings 20*e*, 20*f* rest against stop members 29*e*, 29*f* formed from the bracket 24.

Figure 4:
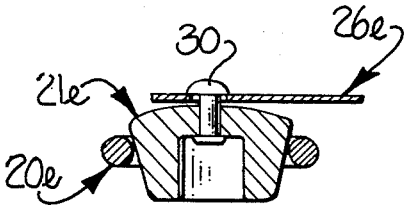
FIG. 4 is a sectional elevation view of the device of FIG. 3, taken generally along the line 4—4 in that figure.

Each of the plugs 21*e*, 21*f* comprises a truncated conical body sized for occluding the corresponding ring 20*e*, 20*f* (FIG. 4). The conical bodies are secured to one end portion of a corresponding pivoting member by suitable means such as a rivet 30 (FIG. 4) in such a manner as to give sufficient looseness for substantial self-alignment of the truncated conical body with the cooperating torus, thereby facilitating ready manufacture and assembly from the arrangement of this invention. The exterior conical surface of the truncated conical body may be roughened for grippingly engaging an entrapped supply strand. In instances where the truncated conical body is machined or cast of metal or the like, such roughening may take the form of knurling. Where the truncated conical body is formed or molded of suitable plastic materials, either a smooth or roughened surface may be usable.

In order to readily identify for a machine operator a drafting system at which supply strand feed has been interrupted, as described for example in aforementioned related U.S. Pat. No. 3,726,072, the pivoting members 26 include flag portions (such as the flag portions 31*e*, 31*f* in FIG. 3) which serve the additional function of counterbalancing the weight of the plugs 21.

It is believed that the above description and the accompanying illustrations will make clear to persons skilled in the pertinent textile arts the advantages of ready interchangeability of the arrangement of this invention among a wide variety of textile yarn forming machines and creel arrangement for those machines, as well as more positive interruption of supply strand feeding which are accomplished by the present invention. In the drawings and specification, there has been set forth a preferred embodiment of the invention, and although specific terms are employed, they are used in a generic and descriptive sense only and not for purposes of limitation.

That which is claimed is:

1. In the combination of a textile yarn spinning machine having a plurality of drafting systems arranged in a series, a plurality of supply strand packages each normally delivering a corresponding supply strand to a corresponding drafting system for producing a corresponding attenuated strand and a plurality of trumpet means each mounted adjacent a corresponding drafting system for directing the corresponding supply strand thereinto, means movable along the spinning machine and having detector means for monitoring production of attenuated strands and actuator means for responding to breakage of an attenuated strand, and means mounted on the spinning machine and selectively remotely actuable by the actuator means for interrupting feeding of the corresponding supply strand at a point in advance of introduction thereof into the corresponding trumpet means, an improvement in the interrupting means which assures positive interruption of supply strand feeding, the improvement comprising:

a plurality of ring means arranged in a series adjacent the series of drafting systems, each said ring means being interposed between a corresponding supply package and the corresponding trumpet means for threadingly receiving the corresponding supply strand, and a plurality of plug means for cooperating with said ring means, each said plug means being mounted for movement relative to a corresponding ring means between a strand feeding position withdrawn from said corresponding ring means and a strand interruption position penetrating said corresponding ring means, said cooperating plug means and ring means positively entrapping a threadingly received supply strand upon movement of said plug means to the strand interruption position.

2. Apparatus according to claim 1 wherein each said ring means comprises a generally horizontally disposed torus and further wherein each said plug means is mounted for pivotal movement about an axis spaced above the corresponding drafting system.

3. Apparatus according to claim 1 wherein each said drafting system is mounted for directing strands downwardly and outwardly therethrough and further wherein each said ring means defines a threading split at an outward portion thereof for facilitating threading of supply strands thereinto while avoiding interference with normal advancement of supply strands therethrough.

4. Apparatus according to claim 1 wherein each said plug means comprises a truncated conical body sized for occluding said corresponding ring means.

5. Apparatus according to claim 4 wherein each said truncated conical body has a roughened exterior conical surface for grippingly engaging an entrapped supply strand.

* * * * *